United States Patent [19]

Ramasco

[11] Patent Number: 4,564,979

[45] Date of Patent: Jan. 21, 1986

[54] COMBING MACHINE FOR TEXTILE FIBRES

[75] Inventor: Carlo Ramasco, Sesto Calende, Italy

[73] Assignee: Sant' Andrea Novara Officine Meccaniche e Fonderie, Novara, Italy

[21] Appl. No.: 618,860

[22] Filed: Jun. 8, 1984

[30] Foreign Application Priority Data

Jun. 9, 1983 [IT] Italy ..... 53444/83[U]

[51] Int. Cl.[4] ..... D01G 19/00

[52] U.S. Cl. ..... 19/215; 19/115 R; 19/225; 19/231; 19/235

[58] Field of Search ..... 19/215, 218, 220, 225, 19/230, 231, 232, 235, 229

[56] References Cited

U.S. PATENT DOCUMENTS 464,718 12/1891 Thorp ..... 19/218

FOREIGN PATENT DOCUMENTS 1207441 9/1970 United Kingdom ..... 19/231

*Primary Examiner*—Louis K. Rimrodt
*Assistant Examiner*—J. L. K. Olds
*Attorney, Agent, or Firm*—Sughrue, Mion, Zinn, Macpeak & Seas

[57] ABSTRACT

A combing machine for textile fibres has a "gill" for combing a sliver of fibres and means for tearing successive tufts from the sliver of fibres as the tufts are combed, and partially superimposing the torn tufts on each other so as to form a continuous combed web. The tearing and superimposition is effected by contra-rotating tearing rollers mounted on support shafts which are rotatably supported at their ends by a pivotable carriage; each support shaft is also rotatably supported intermediate its ends, and carries two tearing rollers side by side and cooperating with a corresponding pair of tearing rollers mounted side by side on the contra-rotating support shaft.

1 Claim, 3 Drawing Figures

COMBING MACHINE FOR TEXTILE FIBRES

The present invention relates to a combing machine for textile fibres of the type including:

means for combing a sliver of fibres, means for tearing successive tufts from the sliver of fibres as the tufts are combed, and means for partially superimposing the torn tufts on each other so as to form a continuous combed web, in which the tearing and superimposition means include a pivotable carriage carrying contra-rotating tearing rollers, the tearing rollers being mounted on shafts rotatably supported at their ends by the pivotable carriage.

The object of the present invention is to provide a machine of the type specified above which has a high production capacity and a relatively simple and reliable structure.

In order to achieve this object, the invention provides a combing machine of the type specified above which is characterised in that each support shaft for the tearing rollers is also rotatably supported by the pivotable carriage intermediate its ends, and in that each support shaft carries two tearing rollers side by side and cooperating with a corresponding pair of tearing rollers mounted side by side on a support shaft which rotates in the opposite sense from the first-mentioned one.

The present invention will now be described with reference to the appended drawings, provided purely by way of non-limiting example, in which:

FIG. 1 illustrates schematically part of the combing assembly 1 of known type of the combing machine according to the invention.

Figure 1:
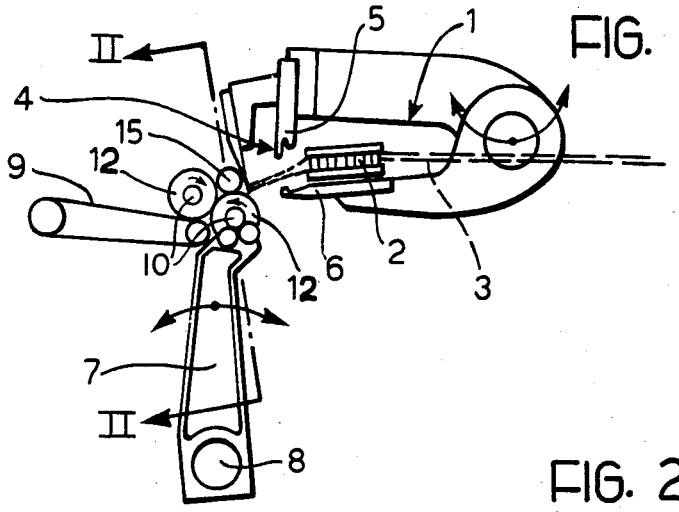
FIG. 1 is a partial schematic side view of a combing machine according to the invention.

The assembly 1 includes a needle field 2 called a "gill" to which is fed a sliver of fibres 3 which is subjected to a first straightening action by the field of needles. At the outlet from the gill is a gripper 4 formed by an upper jaw 5 and a lower jaw 6. The drawing, for reasons of simplicity and clarity, does not show the usual circular comb which is located below and downstream of the gripper 4 and has the function of combing the head of the sliver of fibres 3 which projects beyond the gripper.

According to the conventional method, the machine illustrated in FIG. 1 has means for tearing successive tufts from the sliver of fibres 3 as these tufts are combed, and means for partially superimposing the torn tufts on each other so as to form a continuous combed web. The tearing and superposition means include a carriage 7 which can pivot about an axis 8 and carries a series of tearing rollers which will be described below. Downstream of the tearing rollers is a conveyor belt 9 which conveys the combed superposed tufts to the outlet of the machine.

Figure 2:
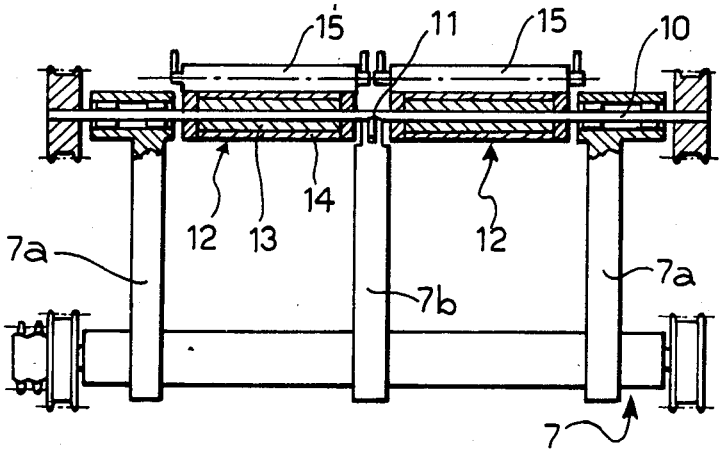
FIG. 2 is a section taken on line II—II of FIG. 1.

With reference to FIG. 2, the various tearing rollers are mounted on shafts 10 (one of which is visible in FIG. 2) rotatably supported at their ends by arms 7*a* of the pivoted carriage 7.

According to the characteristic of the invention, each shaft 10 is also supported at an intermediate zone 11 by the pivoted carriage 7. In the embodiment illustrated in FIG. 2, a further arm 7*b* is provided for this purpose and is disposed in a position intermediate the arms 7*a*. The intermediate support of the shaft 10 divides the latter into two spans each of which supports a corresponding tearing roller 12.

By virtue of this characteristic, the machine according to the invention has a high production capacity compared with conventional machines in which each shaft 10 supports a single treatment roller. Indeed in the absence of the intermediate bearing, the support shaft for the tearing roller cannot exceed a certain length, since any bending of the shaft itself must be avoided. At the same time, the speed of transport of the sliver of fibres cannot exceed a certain value since too high a speed could cause the superposed tufts carried by the conveyor 9 to separate. In the embodiment illustrated in FIG. 2, each tearing roller 12 has a length of about 400 mm whereby the weight of fibres which is conveyed to the outlet of the machine per unit time is considerably greater than that in conventional machines, in which the single roller is usually 450 mm long.

The particular conformation of each tearing roller, and the relative disposition of the various tearing rollers which are described below with reference to FIGS. 1 and 2, form the subject of a copending Italian Utility Model Application filled by the same Applicants. It should be noted however that the characteristic mentioned above which forms the subject of the present invention could also be used in a machine having tearing rollers disposed in the conventional manner.

According to the conventional method, the tearing assembly includes two contra-rotating tearing rollers, one of which acts as a drive roller for the conveyor belt 9, the other roller being located above it and pressing on the conveyor belt 9. In this known solution the two rollers are metal and are grooved. The tearing action is achieved by the pinching of the head of the various fibre tufts between the upper tearing roller and the conveyor belt. This causes a non-gradual tearing of the tufts and may cause wear of the conveyor belt.

In the embodiment illustrated in FIG. 1, the belt 9 does not participate in the tearing action, this instead being carried out by the tearing rollers mounted on the two contra-rotating shafts indicated by reference numeral 10 in FIG. 1.

Each of the shafts 10 supports a pair of rollers 12, as indicated above.

Each of the tearing rollers carried by the shafts 10 has a metal core 13 and an outer rubber cladding 14.

The pair of rollers 12 which is mounted on one of the two shafts 10 is pressed against the conveyor belt 9 while the other pair of rollers 12 is pressed upon by a pair of metal rollers 15. In order to avoid any sliding, both the shafts 10 are rotatably driven, which is different from the conventional solution in which the tearing roller which presses on the conveyor belt is freely rotatably mounted and is rotated by the conveyor belt itself.

Figure 3:
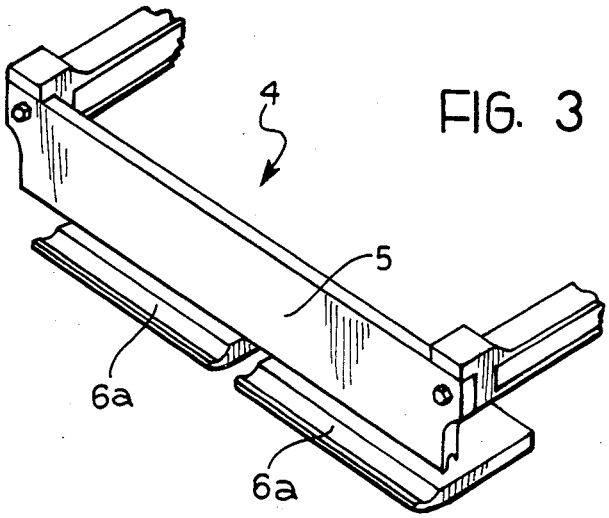
FIG. 3 is a perspective view on an enlarged scale of a detail of FIG. 1.

FIG. 3 illustrates the gripper 4 of the machine according to the invention in perspective. As illustrated, the upper jaw 5 is formed in a single piece while the lower jaw 6 is constituted by two separate parts 6*a*.

What is claimed is:

1. A combing machine for textile fibres, comprising:

means for combing a sliver of fibres;

a pivotable carriage;

contra-rotating tearing rollers mounted on the carriage;

respective contra-rotating shafts on which said support tearing rollers are mounted said shafts being rotatably supported at their ends by the pivotable carriage, said rollers being effective to tear successive tufts from the sliver of fibres as the tufts are combed, and partially to superimpose the torn tufts on each other so as to form a continuous combed web, wherein the improvements consist in support means on the pivotable carriage for rotatably supporting each support shaft for the tearing rollers intermediate the ends of said shaft, and each support shaft carries two said tearing rollers disposed on opposite sides of said support means cooperating with a corresponding pair of said tearing rollers mounted on opposite sides of said support means on a respective said contra-rotating support shaft.

* * * * *